US009651060B2

(12) United States Patent
Morel et al.

(10) Patent No.: US 9,651,060 B2
(45) Date of Patent: May 16, 2017

(54) CASING FOR TURBOMACHINE BLISK AND TURBOMACHINE EQUIPPED WITH SAID CASING

(71) Applicant: SNECMA, Paris (FR)

(72) Inventors: Cedric Morel, Moissy-Cramayel (FR); Pascal Romano, Moissy-Cramayel (FR)

(73) Assignee: SNECMA, Paris (FR)

( * ) Notice: Subject to any disclaimer, the term of this patent is extended or adjusted under 35 U.S.C. 154(b) by 412 days.

(21) Appl. No.: 14/385,328

(22) PCT Filed: Mar. 7, 2013

(86) PCT No.: PCT/EP2013/054636

§ 371 (c)(1),
(2) Date: Sep. 15, 2014

(87) PCT Pub. No.: WO2013/135561

PCT Pub. Date: Sep. 19, 2013

(65) Prior Publication Data

US 2015/0037142 A1 Feb. 5, 2015

(30) Foreign Application Priority Data

Mar. 15, 2012 (FR) ..... 12 52366

(51) Int. Cl.
*F01D 11/12* (2006.01)
*F04D 29/52* (2006.01)
(Continued)

(52) U.S. Cl.
CPC ..... *F04D 29/667* (2013.01); *F01D 11/122* (2013.01); *F04D 29/526* (2013.01);
(Continued)

(58) Field of Classification Search
CPC .... F01D 11/122; F01D 11/125; F04D 29/526; F04D 29/66; F04D 29/661; F04D 29/663;
(Continued)

(56) References Cited

U.S. PATENT DOCUMENTS 4,540,335 A * 9/1985 Yamaguchi ..... F01D 7/00 415/129
4,990,053 A 2/1991 Rohne
(Continued)

FOREIGN PATENT DOCUMENTS

EP 0 348 674 A1 1/1990
EP 0 754 864 A1 1/1997
(Continued)

OTHER PUBLICATIONS

French Preliminary Search Report and Written Opinion issued Dec. 3, 2012, in French Patent Application No. 1252366 with English translation of category of cited documents.
(Continued)

*Primary Examiner* — Gregory Anderson
*Assistant Examiner* — Christopher R Legendre
(74) *Attorney, Agent, or Firm* — Oblon, McClelland, Maier & Neustadt, L.L.P.

(57) ABSTRACT

A casing for a blisk of a turbomachine including an internal coating made of an abradable material, and a plurality of circumferential slots arranged in the coating of abradable material, the casing further including a circumferential cavity formed in the coating of abradable material, into which cavity the slots open, the slots opening into the cavity and extending between the cavity and an internal surface of the casing. A turbomachine can include such a casing and a blisk.

10 Claims, 2 Drawing Sheets

(51) Int. Cl.
*F04D 29/66* (2006.01)
*F04D 29/68* (2006.01)

(52) U.S. Cl.
CPC ..... *F04D 29/663* (2013.01); *F04D 29/685* (2013.01); *F05D 2300/611* (2013.01)

(58) Field of Classification Search
CPC .... F04D 29/664; F04D 29/665; F04D 29/667; F04D 29/668; F04D 29/685; F05D 2300/611
See application file for complete search history.

(56) References Cited

U.S. PATENT DOCUMENTS 5,586,859 A * 12/1996 Nolcheff ..... F01D 11/08 415/173.1
5,707,206 A 1/1998 Goto et al.
6,830,428 B2 * 12/2004 Le Biez ..... F01D 5/20 415/173.4
8,602,720 B2 * 12/2013 Goswami ..... F01D 11/08 415/119
8,845,269 B2 * 9/2014 Agneray ..... F04D 27/0207 415/220
2007/0147989 A1 * 6/2007 Collins ..... F01D 11/02 415/173.1
2008/0044273 A1 * 2/2008 Khalid ..... F04D 29/164 415/57.4
2009/0014234 A1 * 1/2009 Bagnall ..... F02C 7/045 181/214
2011/0311354 A1 12/2011 Goswami et al.
2012/0003085 A1 1/2012 Agneray et al.
2013/0280046 A1 * 10/2013 Morel ..... F02C 6/08 415/119
2015/0037142 A1 * 2/2015 Morel ..... F04D 29/526 415/119
2016/0230776 A1 * 8/2016 Bennington ..... F04D 29/526

FOREIGN PATENT DOCUMENTS

EP 2 940 374 A1 6/2010
JP H08-200008 8/1996
WO WO 9534745 A1 * 12/1995 ..... F01D 11/02
WO WO 2012/095592 A1 7/2012

OTHER PUBLICATIONS

International Search Report and Written Opinion issued Jun. 10, 2013, in PCT/EP2013/054636 with English translation of category of cited documents.
International Search Report issued Jun. 10, 2013, in PCT/EP13/054636 filed Mar. 7, 2013.

* cited by examiner

CASING FOR TURBOMACHINE BLISK AND TURBOMACHINE EQUIPPED WITH SAID CASING

FIELD OF THE INVENTION

The invention relates to the field of turbomachines providing propulsion of aeronautical engines.

More particularly, it relates to casings for a blisk of such turbomachines.

PRIOR ART

Propulsion of civil transport planes must respect two sometimes contradictory conditions:

First, providing good aerodynamic performance when cruising,

And respecting stricter and stricter acoustic certification standards in takeoff and landing phases.

This last condition involves finding solutions for reducing noise generated by an aircraft on takeoff and landing. A major component of total noise generated by a turbomachine of an aircraft originates from the existence of vortices occurring in the fan of the turbomachine. These vortices originate from play between the fan casing and the radially external ends of the blades of the fan, which make the airflow turbulent at this point.

As a consequence, the aim is to develop turbomachines whereof the casing and the fan, comprising a blisk, are designed to minimise noise generated by the fan, particularly during takeoff and landing phases, without any drop in aerodynamic performance when cruising.

In this respect, casings have been developed whereof the internal surface, located opposite the mobile blades, is modified to diminish turbulence from flow and therefore noise resulting from this turbulence.

Modifications to the surface of the casing, aiming at reducing noise interaction of blades of a fan with the casing, have been proposed in documents FR2929349 and FR2940374, for example.

FR 2940374 proposes a blisk casing containing cavities placed opposite the blades. The dimensioning and disposition of the cavities relative to the blades are adapted in particular in this document to provide improved aerodynamic performances, and reduced noise.

FR 2929349 proposes a blisk casing comprising on its internal surface a plurality of circumferential grooves (symmetrical revolution grooves about the axis of the casing). Also, the surface of the cross-section of these grooves decreases from the first groove, located upstream of the casing, towards the last groove, located relatively further downstream.

In document US 2011/0311354, a cavity made in a casing connects a plurality of slots.

In document EP 0 754 864, high-pressure fluid is injected into a cavity connecting a plurality of slots to generate a current opposing the current in the turbomachine. The resulting slots and the cavity therefore do not sample airflow in the turbomachine to decrease the turbulent flow.

Modifications to the internal surface of the casing by arrangement of grooves in said internal surface have already proven to be useful. But, it has been noted by numerical flow simulation studies in these grooves that by being independent relative to each other they do not all contribute in the same way to the resulting aerodynamic gain.

In particular, the grooves located farthest downstream from the casing allow low aerodynamic gains only relative to those located upstream.

For example, it is evident that the aerodynamic gain noted on a casing comprising four consecutive grooves is substantially equal to the gain obtained on a casing comprising three consecutive grooves only.

There is therefore a need to further improve the aerodynamic gain by surface modification of the casing, or casing treatment, to boost acoustic performances of the fan and boost the contribution to the aerodynamic gain of slots located downstream.

PRESENTATION OF THE INVENTION

The aim of the present invention is to rectify the above problems by proposing a blisk casing exhibiting aerodynamic performances improved relative to the prior art.

To this end, the aim of the invention is a casing for blisk of a turbomachine comprising an internal coating of abradable material, and a plurality of circumferential slots arranged in said coating, said casing also comprising a circumferential cavity made in the coating of abradable material, said slots terminating in said cavity and extending between said cavity and the internal surface of the casing.

Advantageously, but optionally, the invention can also comprise at least one of the following characteristics:

- as the coating of abradable material has a thickness between 20 and 25 mm, the cavity has in this thickness a height between 5 and 10 mm.
- the cavity extends into the coating of abradable material by being offset upstream relative to the slot located the highest on said casing, and the number of slots is between 4 and 8.
- in the thickness of the coating of abradable material each slot has a height between 10 and 15 mm.
- each slot has a width between 2 and 6 mm.
- the spacing between two consecutive slots is between 0.5 and 3 mm.
- each of the slots extends in a plane forming an angle with the between 70 and 110°.

Another aim of the invention is a turbomachine, comprising a blisk and a blisk casing as claimed in any one of the preceding claims.

Advantageously, but optionally, the turbomachine according to the invention can also comprise at least one of the following characteristics:

- the cavity of the casing is located opposite the radially external end of the blades of the wheel by being offset upstream relative to the leading edge of the blades by a distance between 2 and 10 mm.
- the slot located the highest in the casing is offset upstream relative to the leading edge of the blades by a distance between 1.5 and 3.5 mm.

DESCRIPTION OF FIGURES

Other characteristics, aims and advantages of the invention will emerge from the following description which is purely illustrative and non-limiting, and which must be considered in relation to the appended drawings, in which.

DETAILED DESCRIPTION OF AT LEAST ONE EMBODIMENT

Figure 1:
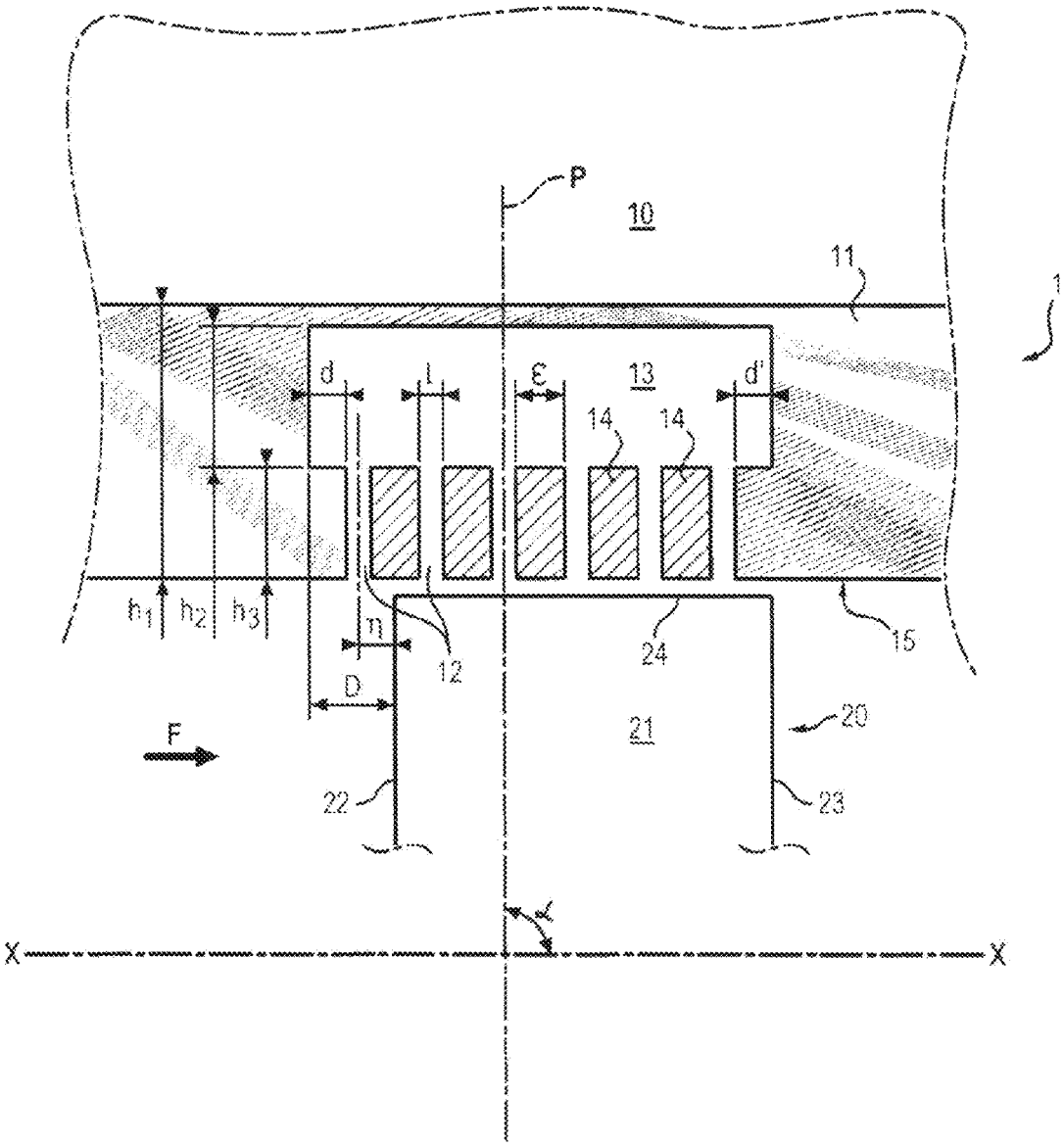
FIG. 1 is an axial section of a turbomachine comprising a mobile blisk and a casing according to the invention.

FIG. 1 illustrates a casing 10 of a blisk 20 of a turbomachine 1. The blisk 20, located inside the casing 10, is the fan of the turbomachine. It comprises a plurality of blades 21, mounted to rotate about an axis X-X of rotation of the fan.

Each blade 21 has a leading edge 22, a trailing edge 23 and a radially external end 24 opposite the internal surface 15 of the casing. This end 24 is therefore compelled to move at high speed in the vicinity of the internal surface 15 of the fixed casing 10, causing turbulent airflow at this point, said turbulent airflow being the origin of sound nuisance.

The general direction of airflow in the turbomachine 1 is shown by the arrow F, which is substantially parallel to the axis X-X of rotation of the fan 20, and moves from the leading edge towards the trailing edge of each blade. Hereinbelow, upstream and downstream are used to locate elements of the casing, and are taken relative to the direction of airflow.

The casing 10, mounted fixed about the blisk 20, is a piece of revolution about a casing axis which joins with the axis X-X of rotation of the blisk 20. The axis of rotation X-X is also called axis of the casing hereinbelow.

The casing 10 comprises an internal coating 11 made of abradable material, the surface of the coating defining the internal surface 15 of the casing 10. This coating has a thickness $h_1$, measured radially relative to the axis of rotation X-X, between 20 and 25 mm.

In the coating 11 of abradable material and opposite the radially external end 24 of the blades 21 is a plurality of slots 12. These slots 12 are circumferential, that is, they have a circular cross-section in a plane P orthogonal to the axis X-X of the casing, and surround the casing in this plane.

In the coating 11 of abradable material there is also a circumferential cavity 13, circular about the slots 12, such that the slots 12 extend between the cavity 13 and the internal surface 15 of the casing 10. The cavity 13 is also opposite the radially external end 24 of the blades 21.

Also, the slots 12 terminate in the cavity 13, allowing some of the airflow F to penetrate inside the cavity 13 via some slots, and to come out of there into other slots. Advantageously, all slots 12 terminate in the cavity 13.

The intervals 14 between the slots 12 are formed from the same material 11 as the coating of abradable material 11. They can be joined together and to said coating 11 by trigger guards (not shown in the figures) to ensure the assembly is held together.

Figure 2:
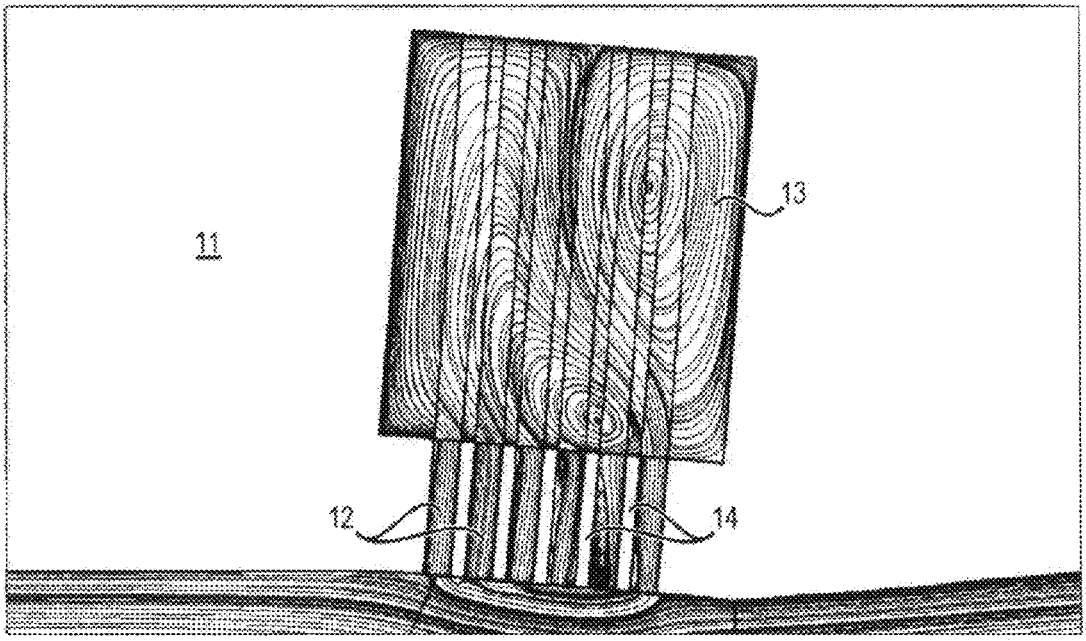
FIG. 2 shows the current lines within a cavity made in a turbomachine casing.

FIG. 2 illustrates the current lines of the airflow at the level of the cavity 13. These current lines reveal the role of the slots located upstream in the casing, relative to the airflow, which sample the vortices linked to the play between the blades 21 and the casing 10, as well as the limit layer of the flow, these two elements being harmful from the aerodynamic viewpoint.

The current lines also show that the slots located downstream of the casing 10 relative to the airflow serve to recirculate the airflow less turbulently within the flow in the fan 20.

In this way, the cavity 13 increases the aerodynamic gain of each slot, particularly by giving the slots farthest downstream a specific role, that of reinjection of the flow into the flow of the fan. This aerodynamic gain is accompanied by reduction in the noise generated by the turbulent flow.

In reference again to FIG. 1, the parameters of the slots 12 and of the cavity 13 have been adapted for optimisation of aerodynamic gain.

The cavity 13 has, in the thickness of the coating of abradable material, a height $h_2$, measured radially relative to the axis X-X.

In the thickness of the coating 11 made of abradable material the slots 12, per se, have a height h3, measured radially relative to the axis X-X.

So that the slots and the cavity are arranged in the coating of abradable material 11, their cumulative height $h_2+h_3$ must be less than the thickness $h_1$ of said coating 11. For a coating of a thickness between 20 and 25 mm, the cumulative height of the slots and of the cavity must be less than or equal to 15 to 20 mm.

Preferably, the height $h_2$ of the cavity 13 is between 5 and 10 mm. A cavity having high volume enables greater sampling of vortices but degrades recirculating the flow in the fan 20. Consequently, a compromise over the volume of the cavity has to be found, and therefore over its height. Advantageously, this compromise is attained for a height $h_2$ of the order of 6 mm.

Also, the height $h_3$ of the slots 12 is preferably between 10 and 15 mm, and preferably of the order of 12 mm.

Also, as is evident from FIG. 1, the cavity 13 is offset upstream relative to the first slot 12 which is located the highest in the casing 10. In fact, the cavity 13 must not be flush with the most upstream slot 12, the upstream end of the cavity must not be just under this slot 12, as in this case the current lines of this slot would bifurcate abruptly in the cavity, causing chaotic circulation within this cavity.

Preferably, the cavity 13 has an offset of between 2 and 5 mm, relative to the upstream end of the first slot 12.

The cavity 13 can also have an offset d' relative to the last slot 12 which is the slot located the most downstream in the casing 10.

As for the number of slots 12, this is advantageously between 4 and 8, and more advantageously equal to 6.

In fact, a large number of slots (typically greater than 4) enables an increase of the sampling of vortices, then better reinjection of the flow sampled within the airflow in the fan 20. However, a number of slots over 8 causes an overpressure phenomenon during reinjection of the flow in the fan, which degrades aerodynamic performances.

The number of slots between 4 and 8, and advantageously equal to 6, therefore corresponds to an optimal compromise between these two phenomena.

In reference again to FIG. 1, a double arrow I shows the width of a slot 12. The width I is advantageously the same for all the slots 12, and is between 2 and 6 mm. For example, this width I is equal to 3.5 mm.

FIG. 1 also shows via a double arrow $\epsilon$ the width of an interval 14, i.e. the spacing between two consecutive slots. This spacing is preferably constant for all intervals 14, and between 0.5 mm and 3 mm. Advantageously, the spacing can be equal to 1.5 mm.

Also, the slots 12 extend preferably, but not in a limiting manner, in a plane forming an angle between 70° and 110° relative to the axis of the casing. Advantageously, the slots extend in a plane orthogonal to said axis. FIG. 1 shows the plane P orthogonal to the axis of the casing and the angle a formed between the plane P and the axis.

The parameters relative to the slots which are the height $h_3$, the width I, the spacing $\epsilon$ between two consecutive slots, and the angle $\alpha$ of the slots, are selected to ensure good sampling of the vortices in the airflow of the fan and good circulation of fluid within the cavity 13.

As for the relative positions of the slots 12 and the blades 21 of the blisk 20, the most upstream slot in the casing 10 is preferably offset upstream relative to the leading edge 22 of the blades by a distance η between 1.5 and 3.5 mm, this distance being taken between the middle of the slot in the direction of the axis X-X and the leading edge 22 of the blade 21. This offset enables better sampling of vortices generated by the end 24 of the blade 21.

Finally, since the cavity 13 is offset upstream relative to the first slot 12, it is therefore offset upstream relative to the leading edge 22 of the blade 21. The offset D, shown in FIG. 1, between the upstream end of the cavity in the direction of the axis X-X, and the leading edge 22 of the blade 21, is preferably between 2 and 10 mm, and advantageously equal to 6 mm.

The presence of the cavity 13, also called re-circulating cavity, brings improvement at the aerodynamic and acoustic level by decreasing the turbulent intensity of the airflow near the internal surface of the casing.

Noise originating from the play and interaction between the casing and the blades is diminished, and the contribution of each slot to reduce this noise, both upstream and downstream of the casing, has increased.

The invention claimed is:

1. A casing for a blink of a turbomachine comprising:

an internal coating made of abradable material;

a plurality of circumferential slots arranged in succession in the coating of abradable material, one of the slots being located most upstream;

a circumferential cavity made in the coating of abradable material, in which the slots terminate, the slots terminating in the cavity and extending between the cavity and an internal surface of the casing, such that some of air flow in a vicinity of the internal surface of the casing penetrates inside the cavity via some of the slots and comes out by others of the slots, wherein the cavity extends into the coating of abradable material by being offset upstream relative to the slot located most upstream on the casing.

2. The casing according to claim 1, wherein the coating of abradable material has a thickness between 20 and 25 mm, the cavity has in this thickness, a height between 5 and 10 mm.

3. The casing according to claim 1, wherein a number of slots is between 4 and 8.

4. The casing according to claim 1, wherein each slot has, in a thickness of the coating of abradable material, a height between 10 and 15 mm.

5. The casing according to claim 1, wherein each slot has a width between 2 and 6 mm.

6. The casing according to claim 1, wherein a spacing between two consecutive slots is between 0.5 and 3 mm.

7. The casing according to claim 1, wherein the slots each extend in a plane forming an angle with a longitudinal axis of the casing between 70° and 110°.

8. A turbomachine, comprising a casing according to claim 1 and a blisk.

9. The turbomachine according to claim 8, wherein the cavity of the casing is located opposite a radially external end of blades of the blisk by being offset upstream relative to a leading edge of the blades by a distance between 2 and 10 mm.

10. The turbomachine according to claim 8, wherein the slot located most upstream in the casing is offset upstream relative to the leading edge of the blades by a distance between 1.5 and 3.5 mm.

* * * * *